US006578491B2

(12) United States Patent
Babin

(10) Patent No.: US 6,578,491 B2
(45) Date of Patent: Jun. 17, 2003

(54) EXTERNALLY ACCESSIBLE THERMAL GROUND PLANE FOR TACTICAL MISSILES

(75) Inventor: Bruce R. Babin, Tucson, AZ (US)

(73) Assignee: Raytheon Company, Lexington, MA (US)

( * ) Notice: Subject to any disclaimer, the term of this patent is extended or adjusted under 35 U.S.C. 154(b) by 0 days.

(21) Appl. No.: 09/950,893

(22) Filed: Sep. 10, 2001

(65) Prior Publication Data

US 2003/0047103 A1 Mar. 13, 2003

(51) Int. Cl.[7] ..... F42B 12/00

(52) U.S. Cl. ..... 102/293; 102/374; 244/117 A; 174/15.2; 361/676; 361/700

(58) Field of Search ..... 102/293, 374; 244/163, 158 A, 117 A; 174/15.2; 361/676, 700

(56) References Cited

U.S. PATENT DOCUMENTS 4,000,776 A 1/1977 Kroebig et al.
4,118,756 A * 10/1978 Nelson et al. ..... 165/104.26
4,366,526 A * 12/1982 Lijoi et al. ..... 174/15.2
4,377,198 A 3/1983 Welling et al.
4,673,030 A * 6/1987 Basiulis ..... 165/104.11
4,903,603 A * 2/1990 Longerich et al. ..... 502/328
5,325,913 A * 7/1994 Altoz ..... 165/287
5,780,928 A * 7/1998 Rostoker et al. ..... 257/713
5,825,624 A * 10/1998 Arnold et al. ..... 165/185
6,148,906 A * 11/2000 Li et al. ..... 165/104.26
6,437,981 B1 * 8/2002 Newton et al. ..... 361/700

* cited by examiner

*Primary Examiner*—Michael J. Carone
*Assistant Examiner*—Gabriel S. Sukman
(74) *Attorney, Agent, or Firm*—Renner, Otto, Boisselle & Sklar, LLP

(57) ABSTRACT

A tactical missile includes a heat pipe connecting heat sources with heat sinks within the missile. The system includes a removable external heat dissipation device that connects to the heat pipe while the missile is being tested or reprogrammed. The external heat dissipation device draws heat out of the heat pipe and so maintains the electronic components acceptably cool during extended testing or reprogramming. During the relatively short tactical flight, the heat pipe transfers heat from the electronic components to the heat sinks within the missile. The high heat transfer rate of the heat pipe enables elements such as structural members and propellant to be used as heat sinks, elements not heretofore incorporated into thermal management of the heat generating electronic components.

10 Claims, 1 Drawing Sheet

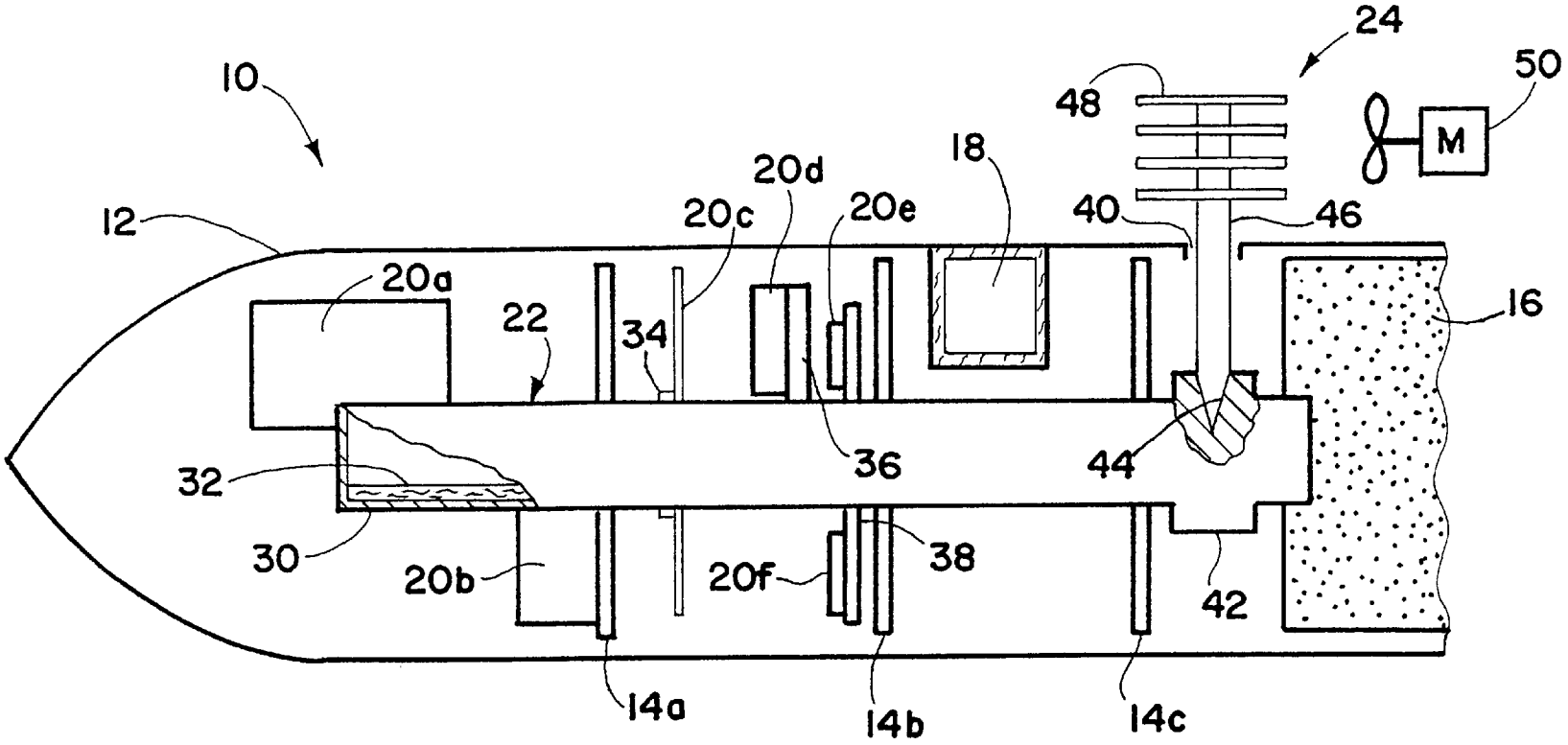
50
M
24
48
46
40
16
42
44
18
20e
20d
20c
34
36
38
20f
22
20a
10
12
32
30
20b
14c
14b
14a

EXTERNALLY ACCESSIBLE THERMAL GROUND PLANE FOR TACTICAL MISSILES

FIELD OF THE INVENTION

The present invention relates to controlling temperatures in electronic components and especially to controlling the temperatures of electronic components in a tactical missile.

BACKGROUND OF THE INVENTION

During the flight of a missile, waste heat is generated by the guidance and control systems. This heat must be dissipated. If the heat is not removed from the systems, they can overheat and fail. During supersonic flight, the outside surface of the missile is too hot to act as a radiator. Accordingly, the excess heat must be absorbed internally.

Flight time for tactical missiles is typically fairly short, on the order of five or six minutes at the most. During this time the electronics packages involved in controlling the flight generate a substantial amount of heat. This heat has been absorbed by appropriately sized metal heat sinks inside the missile. Typically a computer chip may have a copper or aluminum plate, with or without fins, fastened to it to store and re-radiate excess heat. Such heat sinks are able to keep the temperature of the electronics packages below unacceptable levels for the short time required for flight, although they add weight that does not directly increase performance.

The use of heat sinks for each thermally sensitive component ignores the heat capacity of other internal components of the missile such as the structural frame that holds the missile together and the propellant. A heat management system that uses the heat capacity of these internal components could reduce the size of or entirely eliminate many individual heat sinks within the missile.

Tactical missiles are also extensively bench tested and reprogrammed. This testing and reprogramming may take substantially longer than the actual flight time, especially where there are repeated simulations of combat situations. The heat sinks suitable for a six minute flight cannot keep the electronics packages cool enough for a lengthy test or reprogramming.

In the past the electronic components have been kept cool during testing and reprogramming by testing and programming briefly and then allowing the components to cool down. This has the disadvantage of prolonging testing and reprogramming times.

In another approach the components have been kept from overheating by making temporary mechanical connections between the internal heat sinks and the missile housing (skin) during testing. These mechanical connections have been made with thermal diodes that allow heat to flow from the heat sink to the housing so long as the housing is cooler than the heat sink. Such thermal diodes degrade missile performance by adding weight and expense.

Active cooling loops have also been used. These cooling loops provide internal cooling during testing and reprogramming by circulating a fluid heat transfer medium through passages inside the missile. While this allows cooling of the electronics during testing and reprogramming, the space occupied by the cooling system is wasted during tactical flight, thereby decreasing missile performance.

Sometimes specific hardware is created to cool the entire missile during testing and reprogramming. This is effective in the laboratory or at the factory, but usually the cooling equipment is not easily taken into the field for reprogramming during combat.

SUMMARY OF THE INVENTION

The present invention creates a thermal ground plane within a missile. The thermal ground plane connects all thermally significant components within the missile and keeps them at a uniform temperature. During the missile flight the ground plane absorbs excess heat keeping components cool and distributes heat quickly to heat absorbing components within the missile. During testing and reprogramming, the ground plane is attached to an external heat dissipation device through an opening in the skin of the missile. High flow rates of heat through the ground plane and its external cooling device maintain the electronics at a steady-state temperature below the unsafe operating temperature limit during testing and reprogramming.

The thermal ground plane is established within the missile using a heat pipe. This device relies on the circulation and phase change of a fluid to move heat from hotter regions to cooler regions. The heat pipe is connected to all the internal devices that need cooling and to any internal structure that can absorb heat. During tactical flight, the phase change of the fluid from liquid to gaseous and its re-condensation in cooler regions of the heat pipe where energy is absorbed provide enough thermal capacity to keep the components from over heating. Excess heat is rapidly transferred to structural, heat absorbing components of the missile. During testing the external cooling device is connected to the cool region of the heat pipe to draw excess heat out of the missile.

The invention improves missile performance since there are no wasted components carried during tactical flight and little wasted space. In addition, waste heat can be managed comprehensively rather than on a component by component basis.

A preferred embodiment uses a heat pipe to establish a thermal ground plane. Heat pipes have very high thermal conductivity, allowing heat to move rapidly. Like an electrical ground plane which has minimal resistance to the flow of electricity, a thermal ground exhibits minimal resistance to heat flow. For example, a heat pipe may have 10 times the thermal conductivity of a copper bus similarly configured. High thermal conductivity is an important feature of the present invention, and other devices or materials exhibiting high thermal conductivity could be used instead of the heat pipe. For example, encapsulated graphite fiber bundles could be used. The heat pipe may include branches which extend from it to absorb heat from high heat components. The branches may be made of metal such copper or may themselves be heat pipes.

BRIEF DESCRIPTION OF DRAWING

The various features and advantages of the present invention may be more readily understood with reference to the following detailed description taken in conjunction with the accompanying drawing.

The Figure shows the front end portion of a tactical missile in vertical cross section to show internal heat generating and heat absorbing components connected to each other by a heat pipe and a removable external heat dissipation device, all in accordance with the present invention.

DESCRIPTION OF PREFERRED EMBODIMENTS

The missile 10 shown in the drawing figure is a tactical missile intended for flight of at most about five or six minutes at supersonic speeds. The missile 10 has a cylindrical shape with a rounded nose. The missile 10 is given its external shape by a skin or shell 12. The missile 10 includes an internal structural frame shown schematically as bulkheads 14*a*–14*c*. Inside, the missile 10 has propellant 16, a power supply 18, and various electronic components 20*a*–20*f* used to control its flight.

The missile 10 also includes a heat pipe 22 which connects some but not all of the components inside the missile. The heat pipe 22 forms a thermal ground plane which keeps all the components 14, 16, and 20 connected to it at nearly the same temperature, much as an electric ground bus does for electric potentials.

The figure shows an external heat dissipation device 24 which is described below. This device is used during testing and reprogramming of the missile to maintain the thermal ground plane established by the heat pipe 22 at an acceptably cool temperature.

The heat pipe 22 is a conventional heat pipe, including a hollow metal cylinder 30 with a wick 32 lining its inside surface. A heat transfer fluid is place inside the lined cylinder 30 and the cylinder is sealed. As is well known in the art, heat pipes work by absorbing heat when the working fluid evaporates and giving up heat when the working fluid condenses. The working fluid moves in its liquid state from cooler regions to hotter regions through capillary action in the wick 32, while the vapor travels freely down an open core in the center of the heat pipe from the hotter regions to the cooler regions. Suitable wicking materials and fluids are known to those skilled in the art, taking into account the application in a rapidly moving object and the temperature ranges to be encountered.

The heat pipe 22 is connected to all the heat generating devices 20*a*–20*f* that need to be kept from overheating and to every available heat sink 14, 16 within the missile. Various techniques are used to connect the heat sources to the heat pipe 22. Any connection is suitable so long as it has a high thermal conductivity and so allows thermal energy to be transferred to the heat pipe as rapidly as it is generated. For example electronics packages 20*a* and 20*b* are shaped to fit around at least part of the outside of the heat pipe 22. They can be attached to the heat pipe 22 using any suitable cement or bonding arrangement that has a high thermal conductivity. Circuit boards 20*c* may include supporting flanges 34 to mount the circuit board to the heat pipe 22. The supporting flanges 34, in turn, are connected to or integral with metal heat sinks (not shown) connected to the circuit boards to conduct heat from sources of heat such as computer chips to the flange. For especially hot components radial branches 36, 38 may be used. Branch 36 is itself a heat pipe, one end of which is connected to the component 20*d* generating heat, and the other end of which is connected to the central heat pipe 22. The connection is made by any suitable means known to those skilled in the art that allows for the rapid flow of heat from the branch heat pipe 36 to the central heat pipe 22. Any branches from the central heat pipe 22 can be flat plate heat pipe 38 where added efficiency in heat transfer is required or where the heat sources are more widely spread.

The heat pipe 22 is also connected to all possible heat sinks within the missile. These include by way of example, the bulkheads 14*a*–14*c* and the propellant 16. It is preferable to arrange the heat generating elements 20*a*–20*f* and heat absorbing elements 16 within the missile 10 so that heat generating ones are at one end and the heat absorbing elements are at the other end of the heat pipe. In the drawing the heat generating elements 20*a*–20*f* are located toward the forward end of the missile while the heat absorbing propellant 16 is located aft. The bulkheads 14*a*–14*c* are located between the two ends of the heat pipe 22 for structural reasons. Arranging the hottest elements at one end of the heat pipe 22 and the coolest elements at the other facilitates capillary flow of the liquid working fluid from the cooler region to the hotter region.

Some components, such as the thermal battery 18, are insulated from the heat pipe. This is appropriate treatment for any component that generates heat but is not adversely affected by it. For similar reasons the bulkheads 14 are not directly connected to the skin 12. At supersonic speeds the skin 12 is heated by friction with the air. This heat is kept from the components 14, 16, 18, and 20 inside the missile in part by not coupling the skin directly to the bulkheads 14, but instead using insulating fastening systems (not shown).

The heat pipe 22 has a high thermal conductivity, approximately 10 times what a comparably sized and shaped copper bus would achieve. The actual performance of the heat pipe 22 depends on numerous factors including the working fluid chosen, the material and diameter of the heat pipe, and the temperature range over which the heat pipe must operate.

The heat pipe 22 works in a manner analogous to an electrical circuit ground plane, maintaining everything connected to it at a common temperature. The heat pipe 22 has excellent thermal conductivity. Once heat is generated by components 20 attached to the heat pipe 22, the heat is first absorbed by evaporating the fluid within the heat pipe. This fluid moves down the heat pipe 22 to cooler regions where it condenses, giving up its heat to, for example, bulkheads 14 and the propellant 16, or to any other element in the missile 10 that can absorb heat and that is connected to the heat pipe. Because of the rapid heat transfer, using heat pipe 22 means that the management of excess heat generated by the electronic components can be based on the heat capacity virtually the entire missile 10 (structural components, e.g., 14, propellant 16 and heat pipe 22) and not just specific heat sinks for individual heat generating components. With the ability to use the whole missile as a heat sink, it is easier to keep critical electronic components below a maximum allowable temperature, for example, 85 degrees centigrade (85° C.)

Static testing and reprogramming of missile 10 may take a substantial period of time. An external heat dissipation device 24 is provided to maintain the heat pipe 22 at a stable, acceptably cool temperature. The external, removable heat dissipation device 24 is analogous to an electrical ground wire connected to the missile and other electric equipment to prevent shocks, sparks, or the buildup of static electric charge.

The external heat dissipation device 24 extends through an opening 40 in the missile skin and makes a thermal connection with the heat pipe 22. The external heat dissipation device 24 is able rapidly to draw heat out of the heat pipe 22. The heat pipe 22 has a boss 42 to create an enlarged region for contact with and heat transfer to the external heat dissipation device 24. A tapered bore 44 in the boss 42 works for this purpose, but other shapes are also possible. A mechanism such as screw threads or a clamp (not shown) hold the external heat dissipation device 24 in contact with the heat pipe 22 to assure a good thermal connection.

The external heat dissipation device 24, may for example, be a conduit (not shown) with liquid coolant running through it. The coolant may be cooled by a conventional refrigeration apparatus. The external heat dissipation device and 24 may also be another heat pipe 46. In that case, the external heat dissipation device heat pipe 46 has a large surface area such as the fins 48 on its external end portion for transferring heat. An external fan 50 may be used to force an air flow and increase heat transfer. Using a heat pipe 46 and external fan 50 as the external heat dissipation device has the advantage of simplicity and economy over a probe cooled with refrigerant, and is readily available for use in the field. With the external heat dissipation device 24 attached, the missile may be tested and or reprogrammed without overheating. The external heat dissipation device 24 draws heat from the heat pipe, keeping the electronic components 20 which generate heat below critical maximums. When the missile numeral 10 is ready for flight the external heat dissipation device 24 may be removed and the opening 40 in the skin 12 closed with a suitable plug.

Thus it is clear that the present invention provides a method an apparatus for keeping electronic components 20 from overheating both during short missile flights and during prolonged bench testing or reprogramming of the missile, with little sacrifice in missile performance. It is to be understood that the described embodiments are merely illustrative of some of the many specific embodiments which represent applications of principles of the present invention. Numerous other arrangements can be readily devised by those skilled in the art without departing from the scope of the invention.

What is claimed is:

1. A missile system comprising a missile housing, two or more electronics packages, each including a heat source, the packages being disposed within the housing, heat absorbing structural elements within the housing, a heat pipe disposed within the housing and connected to the heat sources and to the heat absorbing structural elements, an access port through the housing to the heat pipe, and a removable heat dissipation device which is connectable to the heat pipe through the access port, and wherein the heat absorbing materials include propellant.

2. The missile system of claim 1 wherein the heat absorbing materials include structural elements of the missile.

3. The missile system of claim 1 further including at least one branch extending from the heat pipe and connected to a source of heat.

4. The missile system of claim 3 wherein the branch includes a heat pipe.

5. The missile system of claim 3 wherein the branch includes a metal heat conductor.

6. The missile system of claim 1 wherein the missile is a tactical missile.

7. The missile system of claim 1 wherein the removable heat dissipation device includes a heat pipe.

8. The missile system of claim 1 wherein the heat pipe in includes a first end portion and second end portion, and wherein at least two heat sources are connected to the first end portion of the heat pipe.

9. The missile system of claim 8 wherein at least two heat tanks are connected to the second end portion of the heat pipe.

10. The missile system of claim 9 wherein the removable heat dissipation device is connected to the second portion of the heat pipe.

* * * * *